US005443639A

United States Patent [19]

Hawkes

[11] Patent Number: 5,443,639

[45] Date of Patent: Aug. 22, 1995

[54] GLUE APPLICATION SYSTEM FOR BOOK BINDING

[75] Inventor: Richard B. Hawkes, Bethlehem, Pa.

[73] Assignee: AM International, Inc., Mt. Prospect, Ill.

[21] Appl. No.: 343,232

[22] Filed: Nov. 22, 1994

[51] Int. Cl.[6] ..... B05C 1/08

[52] U.S. Cl. ..... 118/244; 118/110; 118/202; 118/223; 118/259; 118/667; 118/683; 118/688; 118/712; 412/37

[58] Field of Search ..... 118/101, 110, 202, 221, 118/223, 244, 255, 259, 429, 503, 667, 688, 683, 712; 156/356, 359, 500, 578, 908; 412/11, 13, 14, 37; 427/8, 207.1, 208.8, 411, 428

[56] References Cited

U.S. PATENT DOCUMENTS

| | | | |
|---|---|---|---|
| 3,273,531 | 9/1966 | Boothroyd et al. | 118/302 |
| 3,863,596 | 2/1975 | Anderson | 118/244 |
| 4,565,477 | 1/1986 | Axelrod | 412/5 |
| 4,925,354 | 5/1990 | Cote | 412/8 |
| 5,250,318 | 10/1993 | Tooker | 427/8 |
| 5,261,769 | 11/1993 | Leclerc | 412/37 |

*Primary Examiner*—W. Gary Jones
*Assistant Examiner*—Laura E. Edwards
*Attorney, Agent, or Firm*—Tarolli, Sundheim & Covell

[57] ABSTRACT

A glue application system (10) for applying glue to books (12) moving from a binder (16) along a predetermined path (14) includes a first roller (30) which rotates in the predetermined path to apply glue to the books. A heater (114) maintains the temperature of the first roller at a predetermined temperature. A second roller (32) rotates in the predetermined path, downstream of the first roller, to apply glue to the books. A second heater (130) maintains the temperature of the second roller at a temperature less than the temperature of the first roller. A glue reservoir (50) disposed below the first and second rollers contains a supply of liquid melted glue (56). A pump (70) pumps liquid melted glue up to the first and second rollers. An electric motor drive assembly (89) is selectively engageable to drive the pump when a binder drive assembly (79) is not driving the pump.

17 Claims, 2 Drawing Sheets

GLUE APPLICATION SYSTEM FOR BOOK BINDING

BACKGROUND OF THE INVENTION

1. Technical Field

The present invention relates to a glue application system for applying glue to the backbones of books from a book binder.

2. Description of the Prior Art

Glue application systems for applying glue to books are known in the art. A typical glue application system includes at least one roller which is rotatable about an axis and which has a portion of its periphery located in a reservoir containing a supply of glue. As the roller rotates, its outer surface picks up glue. Books coming from a binder are moved into contact with the glue on the outer surface of the rotating roller. When the books come in contact with the glue, the glue is transferred from the outer surface of the rotating roller to the moving books. In another known glue application system, a glue gun applies glue to the outer surfaces of rollers which do not rotate in the glue supply.

The glue is heated to maintain the glue in a liquid melted condition. The heated glue is circulated by a pump driven off the binder. If the binder is not operated for a period of time, the glue can cool and/or set up. A substantial period of time may be required to heat the glue to a predetermined temperature at which the glue can again be applied to the books. Also, improved binding results when glue is applied to a book at a predetermined application temperature. Therefore, it is desirable to keep the glue heated and circulating in all parts of the glue application system until the glue is applied to the books.

SUMMARY OF THE INVENTION

The present invention is an apparatus for applying glue to books moving from a binder along a predetermined path. The apparatus includes a first roller rotatable about its central axis and having a cylindrical outer surface for receiving glue. The outer surface of the first roller rotates in the predetermined path to apply glue to the books. First heating means maintains the temperature of the first roller at a first predetermined temperature above ambient temperature. A second roller rotatable about its central axis has a cylindrical outer surface for receiving glue. The outer surface of the second roller rotates in the predetermined path, downstream of the first roller, to apply glue to the books. Second heating means maintains the temperature of the second roller at a second predetermined temperature above ambient temperature. A glue reservoir is disposed below the first and second rollers for containing a supply of liquid melted glue. A body of liquid melted glue is disposed in the glue reservoir. A pump connected with the glue reservoir pumps liquid melted glue up to the first and second rollers. Glue applicator means disposed adjacent to the first and second rollers receives glue from the pump and applies glue to the outer surfaces of the first and second rollers.

Drive means for driving the pump includes a binder drive assembly for receiving driving force from the binder. A motor drive assembly is selectively engageable to drive the pump when the binder drive assembly is not transmitting driving force to the pump. The motor drive assembly includes an electric motor, means for connecting the output of the electric motor to the pump, and control means for selectively energizing the electric motor.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

The present invention relates to an apparatus for applying glue to books. The present invention is applicable to various glue application system constructions. As representative of the present invention, FIG. 1 illustrates a hot melt glue application system 10.

Figure 1:
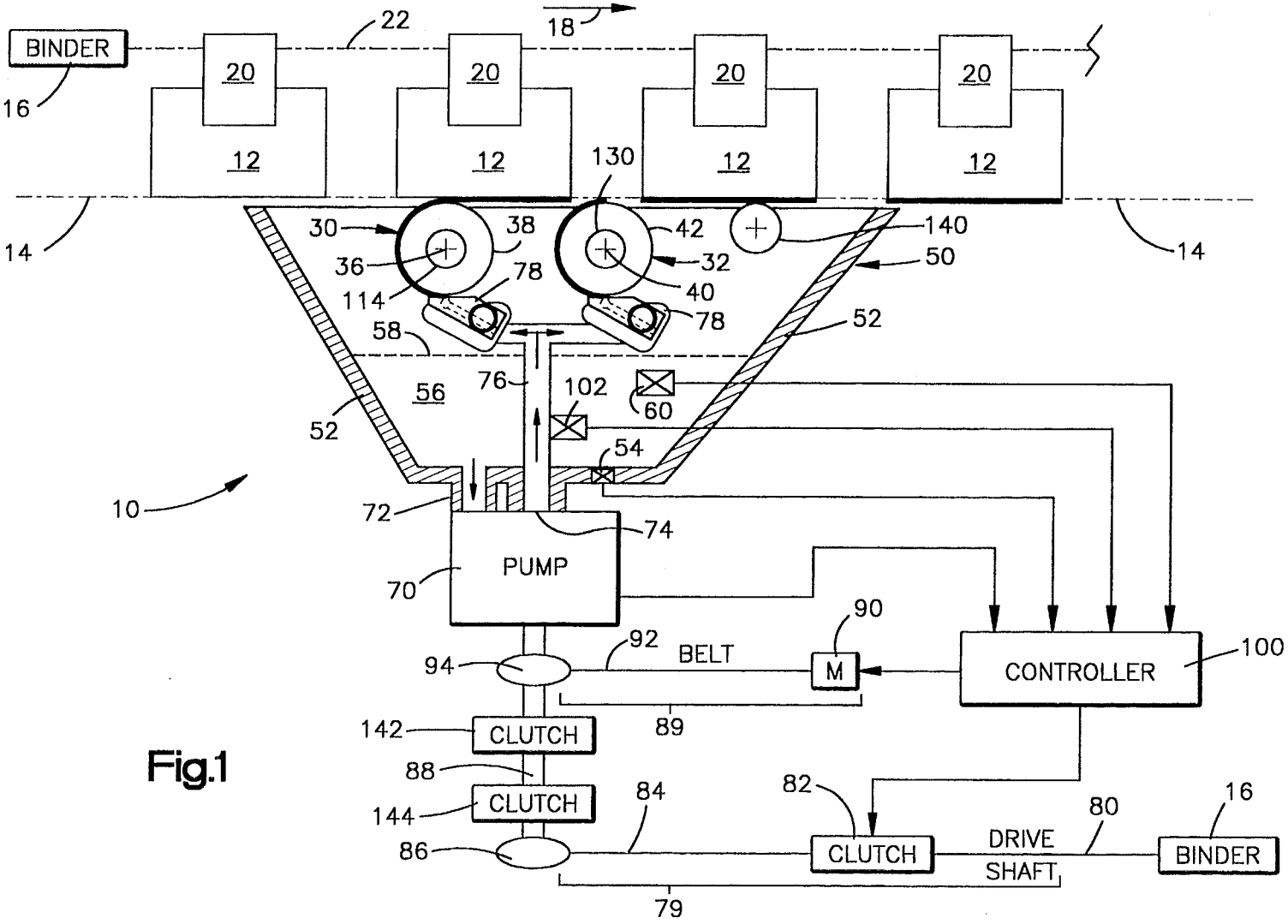
FIG. 1 is a schematic illustration of a glue application system constructed in accordance with the present invention.
Figure 3:
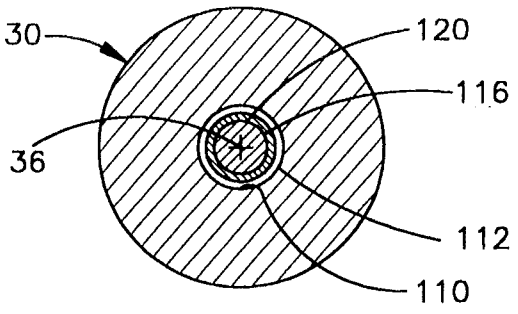
FIG. 3 is a sectional view taken along line 3—3 of FIG. 2.

The system 10 is used for applying glue to a plurality of books 12 moving along a predetermined path 14 from a binder 16, in a direction as indicated by the arrow 18, i.e., to the right as viewed in FIG. 1. The books 12 are held by grippers 20 of a gripper conveyor 22. The grippers 20 support the lower edges of the books 12 in the path 14 for movement relative to first and second glue application rollers 30 and 32.

Figure 2:
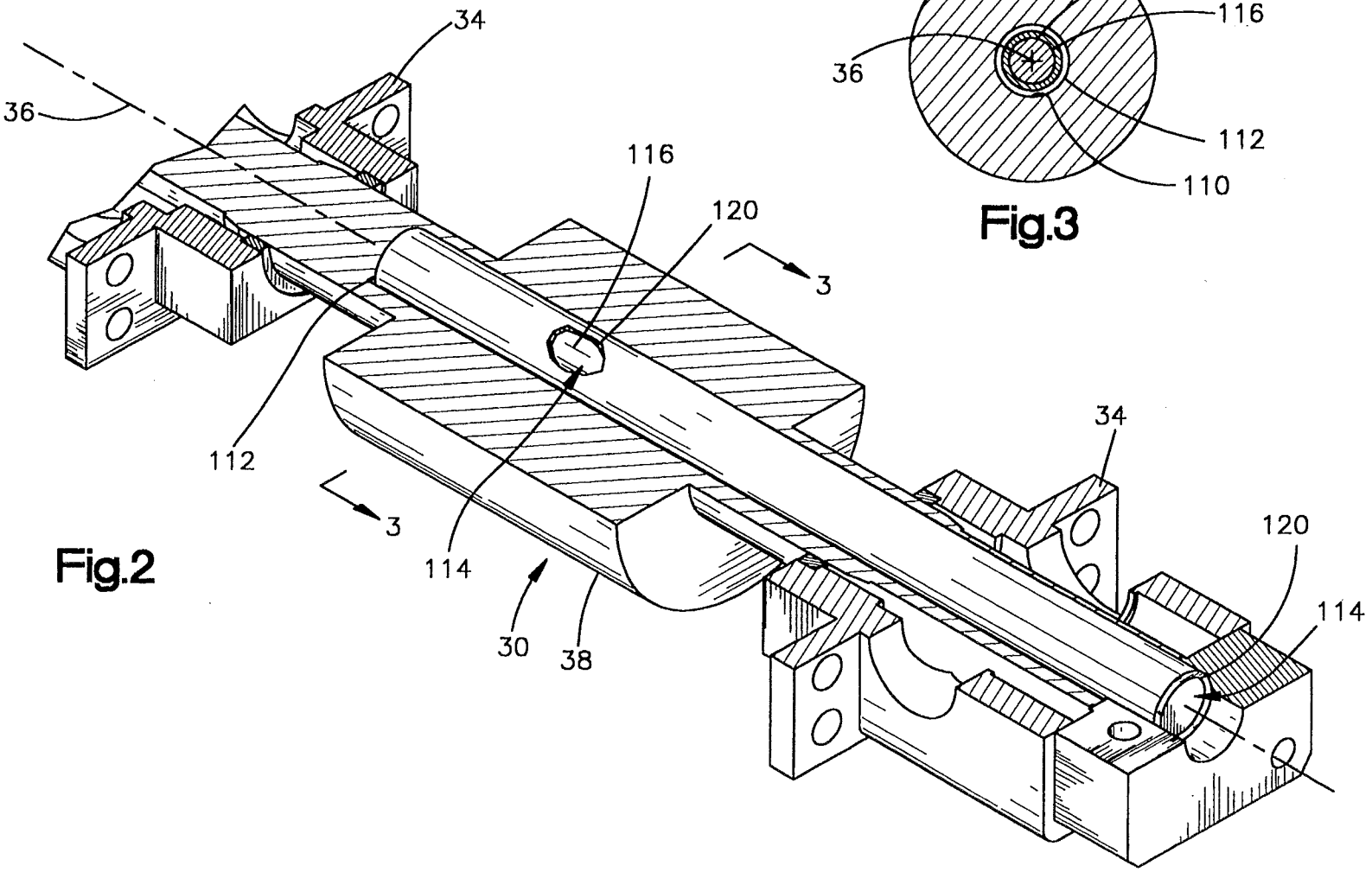
FIG. 2 is an enlarged perspective view, partially in section, of a glue application roller of the system of FIG. 1.

The first glue application roller 30 (FIGS. 1 and 2) is supported by bearings (not shown) on a frame 34 of the system 10 for rotation about a central axis 36. The first roller 30 is preferably made from aluminum coated with polytetrafluoroethylene. The first roller 30 has a cylindrical outer surface 38 for receiving glue and is driven for rotation about the axis 36 in a known manner by a drive shaft 80 coming from the binder 16. The outer surface 38 of the first roller 30 rotates in the predetermined path 14 to apply glue to lower edges of the books 12 moving in the direction 18 along the path.

The second roller 32 is disposed downstream of (i.e., to the right as viewed in FIG. 1) the first roller 30. The second roller 32 is similar in construction to the first roller 30 and is supported by bearings (not shown) on the frame 34 for rotation about a central axis 40. The second roller 32 is driven for rotation about the axis 40 in a known manner by the drive shaft 80 from the binder 16. A cylindrical outer surface 42 of the second roller 32 rotates in the predetermined path 14 to apply glue to the lower edges of the books 12 moving in the direction 18 along the path.

The system 10 further includes a glue reservoir 50 having a plurality of walls 52. A temperature sensor 54 is optionally provided in one of the walls 52 of the reservoir 50. The reservoir 50 contains a body of liquid melted glue 56 which has an upper surface 58. The upper surface 58 of the body of glue 56 is disposed below the first and second rollers 30 and 32. The rollers 30 and 32 are thus disposed out of the body of liquid melted glue 56, above the upper surface 58 of the glue. The rollers 30 and 32 do not rotate in the glue 56. A primary temperature sensor 60 is disposed in the body of glue 56 in the reservoir 50.

A pump 70 is associated with the reservoir 50 for pumping liquid melted glue up to the rollers 30 and 32. The pump 70 is a known gear pump having an inlet 72 and an outlet 74. A manifold 76 is connected with the outlet 74 of the pump 70. The manifold 76 directs glue from the pump 70 to a pair of extruders 78 disposed adjacent to the first and second rollers 30 and 32. Cam operated scrapers (not shown) are associated with the first and second rollers 30 and 32 for removing excess glue from the first and second rollers. A secondary temperature sensor 102 is optionally provided in a wall portion of the manifold 76.

The system 10 includes a binder drive mechanism 79 for driving the pump 70 to pump glue to the first and second rollers 30 and 32. The binder drive mechanism 79 includes the drive shaft 80 which is driven off the binder 16. The output of the drive shaft 80 is connected through a clutch 82 to a drive tube (not shown). The drive tube transmits rotational force through a belt 84, and a pulley 86 to a pump drive member 88. The pump drive member 88, when driven for rotation by the binder drive mechanism 79, causes the pump 70 to pump glue to the extruder 78. The clutch 82 is a Horton pneumatic single position torque limiter clutch that can be pneumatically disengaged. It also provides a torque overload disengagement feature.

The system 10 also includes a motor drive mechanism 89 which includes an electric motor 90. The motor 90 is connected by a belt 92 and a pulley 94 with the pump drive member 88. The motor 90 is selectively energizable by a controller 100, in a manner described below, to drive the pump 70.

The controller 100 is preferably a microprocessor or other type of computer or programmable controller. The controller 100 receives a signal from the primary temperature sensor 60 disposed in the body of melted glue 56. The controller 100 receives a signal from the secondary temperature sensor 54 in the wall 52 of the reservoir 50. The controller 100 also receives a signal from the secondary temperature sensor 102 disposed in the manifold 76.

The system 10 includes first heating means for maintaining the temperature of the first glue application roller 30 at a first predetermined temperature above ambient temperature. A cylindrical inner surface 110 of the first roller 30 defines an axially extending central passage 112 in the first roller. An electric resistance heater 114 is secured on the frame 34 by a clamp mechanism (not shown). A heat radiating portion 116 of the heater 114 extends axially within the passage 112 in the first roller 30. The heater 114 is a known electric resistance cartridge heater, preferably an internal thermocouple, Style A, Code J heater which can be obtained from Watlow Company, 12001 Lackland Road, St. Parris, Mo. 63416.

The heater 114 radiates heat radially outward to heat the first roller 30. The heater 114 is controlled and actuated in a known manner (not shown) by the controller 110. A thermocouple in the heater 114 is used in sensing the temperature of the first roller 30.

A tubular cylindrical heat transfer sleeve 120 is fitted around the heat radiating portion 116 of the heater 114. The heat transfer sleeve 120 is preferably made from aluminum. The heat transfer sleeve 120 stabilizes the heating effect of the heater 114 by acting as a heat sink to retain heat when the heater is cycled on and off. The cylindrical inner surface 110 of the roller 30 is spaced radially outward from the cylindrical outer surface of the heat transfer sleeve 120. An annular air gap is thereby formed between the inner surface 110 of the first roller 30 and the outer surface of the heat transfer sleeve 120. The first roller 30 is supported for rotation on the frame 34, not on the heater 114 or the sleeve 120.

The system 10 includes second heating means 130 (FIG. 1) for maintaining the temperature of the second glue application roller 32 at a second predetermined temperature above ambient temperature. The temperature of the second roller 32 is preferably maintained at a predetermined temperature which is less than the temperature of the first roller 30. The second heating means 130 can be identical to the first heating means including the heater 114 and the heat transfer sleeve 120. The second heating means 130 is controlled and actuated in a known manner by the circuitry which controls the first heater 114.

In operation of the system 10, the glue 56 in the reservoir 50 is heated by heating components of the system which engage the glue, including the walls 52 of the reservoir 50 and the manifold 76. The glue 56 is heated to a predetermined application temperature, preferably about 350° F. At the predetermined temperature, the glue 56 is in a liquid melted state.

When books 12 coming from the binder 16 are to be glued, the binder drive mechanism 79 is engaged and transmits driving force from the binder 16 to the pump 70. Driving force is transmitted from the binder 16 through the drive shaft 80, the clutch 82, the belt 84 and the pulley 86 into the pump drive member 88. The pump drive member 88 rotates and causes the pump 70 to pump liquid melted glue 56 from the reservoir 50 up through the manifold 76 to the extruder 78. The pump 70 operates at a speed proportional to the speed of the binder 16.

Glue is extruded onto the rotating outer surface 38 of the first roller 30. Preferably, a 10 mil layer of glue is extruded onto the rotating outer surface 38 of the first roller 30. The first roller 30 applies the glue to the lower edges of the books 12 traveling in the predetermined path 14. The scraper (not shown) which is associated with the first roller 30 removes excess glue from the rotating outer surface 38 of the first roller. The excess glue drops into the reservoir 50.

Glue is also extruded onto the rotating outer surface 42 of the second roller 32. The second roller 32 applies glue to the lower edges of the books 12 at a location along the predetermined path which is downstream of the first roller 30. The scraper (not shown) which is associated with the second roller 32 removes excess glue from the rotating outer surface 42 of the second roller. The excess glue drops into the reservoir 50. A spinner wheel 140 (FIG. 1) removes excess glue from the lower edges of the books 12, at a location downstream of the second roller 32.

The application temperature of the glue 56, that is, the preferred temperature at which the glue is applied to the books 12, is about 350° F. If the first roller 30 is at an undesirably low temperature, the glue can undesirably cool to a temperature below the desired application temperature prior to being applied to the books 12. In accordance with the present invention, the first roller 30 is heated to a predetermined temperature which is preferably about 350° F. Thus, liquid melted glue which is applied to the rotating outer surface 38 of the first roller 30 retains its temperature while it is on the outer surface of the first roller and while it is being applied to the lower edges of the books 12. The glue applied from the first roller 30 thus has a low viscosity to wet and encapsulate the fibers of the signatures of the books 12. Pressure can also be applied by the roller 30 onto the books 1 to achieve better penetration of the glue into the fibers of the books 12.

The temperature of the second roller 32 is preferably maintained at a predetermined temperature which is less than the temperature of the first roller 30. The second roller 32 is preferably maintained at a temperature of about 280° F. to 300° F. At this temperature of the second roller 32, the glue on the rotating outer surface 42 of the second roller is more viscous and thicker. This is desired in order to build up the glue on the lower edges of the books 12 when they engage the second roller 32. The glue on the rotating outer surface 42 of the second roller 32 is nevertheless hot enough to flow well along the books 12. The second roller 32 may flood the books 12 with more glue than is needed. Excess glue is removed by the spinner wheel 140.

The binder 16 is at times shut down for a long enough period of time so that the entire system 10 must be shut down and the glue 56 cools and solidifies. The glue 56 is heated first when the system 10 is restarted. If the system 10 is restarted when the glue 56 is not yet in a liquid melted state, damage can occur to parts of the glue applying system 10. Also, the rollers 30 and 32 would not be able to apply glue in the desired liquid state to books 12 moving in the path 14. Accordingly, it is desirable to avoid starting operation of the system 10 until the glue 56 is in a liquid melted state and has reached a predetermined temperature.

To this end, the controller 100 blocks engagement of the binder drive clutch 82 if the temperature of the body of glue 56 is too low. Specifically, the controller 100 monitors the input signals from the primary temperature sensor 60 in the body of glue 56, the secondary temperature sensor 54 in the wall 52 of the reservoir 50, and the secondary temperature sensor 102 on the wall of the manifold 76. If the controller determines that the system 10 including the body of glue 56 is not at a predetermined temperature, the clutch 82 is disengaged and the binder 16 does not transmit driving force to the pump 70. The pump 70 does not operate. The clutch 82 is engaged when the system 10 including the glue 56 is at a predetermined temperature preferably in the range of from about 300° F. to about 315° F. The clutch 82 disengages the drive to rollers 30 and 32 and to the scraper cams as well as to the pump 70. The clutch 82 is the type which can also disengage automatically in the event of an overload. A manual disconnect (not shown) for the clutch 82 is also provided.

If the system 10 were driven solely by the binder drive mechanism 79, the system 10 would be shut down whenever the binder was shut down. When the system 10 is shut down, the glue 56 can cool and solidify. It can take a substantial period of time to reheat the system 10 including the glue 56 when the binder 16 is ready for operation again. To avoid this delay, the motor drive mechanism 89, including the electric motor 90, can be used to circulate glue in the system 10 whenever the binder 16 is not operating. Thus, the controller 100 can keep the glue 56 heated, and the motor drive mechanism 89 can be used to run the pump 70 to circulate the glue, to prevent the glue from undesirably setting up.

When the electric motor 90 is energized, it drives the pump 70 through the belt 92 and the pulley 94. The motor 90 is not energized unless the controller 100 determines that the temperature of the glue 56 is at or above a predetermined temperature, i.e., in the range of from about 300° F. to about 315° F. When the motor 90 is energized, the pump 70 circulates glue through the manifold 76 and the extruders 78. Excess glue spills off the extruders 78 and back into the body of liquid melted glue 56 in the reservoir 50.

A pair overrunning clutches 142 and 144 (FIG. 1) are connected between the binder drive mechanism 79 and the motor drive mechanism 89. The clutches 142 and 144 enable the binder drive mechanism 79 to drive the pump 70 if the binder 16 is rotating the pump drive member 88 faster than the motor 90 is rotating the pump drive member. The overrunning clutches 142 and 144 enable the motor 90 to drive the pump 70 if the motor is rotating the pump drive member 88 faster than the binder drive mechanism 79 is rotating the pump drive member.

From the above description of the invention, those skilled in the art will perceive improvements, changes and modifications in the invention. For example, the heat transfer sleeve 120 can possibly be omitted if the cycling of the heater 114 is properly controlled by the controller 100 or other means. Other temperatures can be selected for the glue rollers 30 and 32 depending on the particular application. Also, the spinner wheel 140 can be heated. Such improvements, changes and modifications within the skill of the art are intended to be covered by the appended claims.

Having described the invention, I claim:

1. An apparatus for applying glue to books moving from a binder along a predetermined path, said apparatus comprising:

a first roller rotatable about its central axis and having a cylindrical outer surface for receiving glue;

means for supporting said first roller so that said outer surface of said first roller rotates in the predetermined path to apply glue to the books;

first heating means disposed within said first roller for maintaining the temperature of said first roller at a first predetermined temperature above ambient temperature;

a second roller rotatable about its central axis and having a cylindrical outer surface for receiving glue;

means for supporting said second roller so that said outer surface of said second roller rotates in the predetermined path, downstream of said first roller, to apply glue to the books;

second heating means disposed within said second roller for maintaining the temperature of said second roller at a second predetermined temperature less than said first predetermined temperature, said second predetermined temperature being above ambient temperature;

a glue reservoir disposed below said first and second rollers for containing a supply of liquid melted glue;

a body of liquid melted glue in said glue reservoir;

glue heater means in communication with said glue reservoir for heating the body of glue and for maintaining the body of glue in a liquid melted state;

a pump connected with said glue reservoir for pumping liquid melted glue up to said first and second rollers; and glue applicator means disposed adjacent to said first and second rollers for receiving glue from said pump and for applying glue to said outer surfaces of said first and second rollers.

2. An apparatus as set forth in claim 1 wherein said first roller has a cylindrical inner surface defining an axially extending central passage in said first roller, said first heating means comprising a cartridge heater supported adjacent to said first roller and having a heat radiating portion extending axially into said central passage in said first roller, said first roller being rotatable around said heat radiating portion of said cartridge heater.

3. An apparatus as set forth in claim 2 further comprising a heat transfer sleeve disposed in said passage intermediate said heat radiating portion of said cartridge heater and said first roller, said heat transfer sleeve having a cylindrical outer surface spaced radially inward from said cylindrical inner surface of said first roller.

4. An apparatus as set forth in claim 1 further comprising drive means connected to said pump for driving said pump, said drive means including:

a binder drive assembly for receiving driving force from the binder and movable between a first condition transmitting driving force to said pump and a second condition not transmitting driving force to said pump; and a motor drive assembly selectively engageable to drive said pump when said binder drive assembly is in the second condition;

said motor drive assembly including an electric motor, means for connecting the output of said electric motor to said pump, and control means for selectively energizing said electric motor.

5. An apparatus as set forth in claim 4 wherein said control means for selectively energizing said electric motor comprises (a) a temperature sensor for sensing the temperature of said body of glue in said glue reservoir and (b) means for selectively energizing said motor in response to the sensed temperature of said body of glue in said glue reservoir.

6. An apparatus as set forth in claim 5 wherein said means for selectively energizing said motor in response to the sensed temperature of said body of glue in said glue reservoir comprises means for energizing said motor in response to sensing that the temperature of said glue is at or above a predetermined temperature.

7. An apparatus as set forth in claim 4 wherein said control means for selectively energizing said electric motor comprises a temperature sensor for sensing the temperature of a wall portion of said glue reservoir in contact with said body of glue.

8. An apparatus as set forth in claim 4 wherein said control means for selectively energizing said electric motor comprises a temperature sensor for sensing the temperature of a wall portion of said glue applicator means.

9. An apparatus as set forth in claim 4 wherein said binder drive assembly includes a binder drive clutch for blocking transmission of driving force in excess of a predetermined amount of force from said binder to said pump.

10. An apparatus as set forth in claim 4 including overrunning clutch means connected with said binder drive assembly and with said motor drive assembly for transmitting driving force from said binder to said pump when both said binder drive assembly and said motor drive assembly are operating.

11. An apparatus for applying glue to books moving from a binder along a predetermined path, said apparatus comprising:

a first roller rotatable about its central axis and having a cylindrical outer surface for receiving glue, and means for supporting said first roller so that said outer surface of said first roller rotates in the predetermined path to apply glue to the books;

a second roller rotatable about its central axis and having a cylindrical outer surface for receiving glue, and means for supporting said second roller so that said outer surface of said second roller rotates in the predetermined path, downstream of said first roller, to apply glue to the books;

a glue reservoir disposed below said first and second rollers for containing a supply of liquid melted glue, and a body of liquid melted glue in said glue reservoir;

a pump connected with said glue reservoir for pumping liquid melted glue up to said first and second rollers;

glue applicator means disposed adjacent to said first and second rollers for receiving glue from said pump and for applying glue to said outer surfaces of said first and second rollers;

a binder drive assembly connected to said pump for receiving driving force from the binder and movable between a first condition transmitting driving force to said pump and a second condition not transmitting driving force to said pump; and a motor drive assembly selectively engageable to drive said pump when said binder drive assembly is in the second condition, said motor drive assembly including an electric motor, means for connecting the output of said electric motor to said pump, and control means for selectively energizing said electric motor.

12. An apparatus as set forth in claim 11 wherein said control means for selectively energizing said electric motor comprises (a) a temperature sensor for sensing the temperature of said body of glue in said glue reservoir and (b) means for selectively energizing said motor in response to the sensed temperature of said body of glue in said glue reservoir.

13. An apparatus as set forth in claim 12 wherein said means for selectively energizing said motor in response to the sensed temperature of said body of glue in said glue reservoir comprises means for energizing said motor in response to sensing that the temperature of said glue is at or above a predetermined temperature.

14. An apparatus as set forth in claim 11 wherein said binder drive assembly includes a binder drive clutch for blocking transmission of driving force in excess of a predetermined amount of force from said binder to said pump.

15. An apparatus as set forth in claim 11 including overrunning clutch means connected with said binder drive assembly and with said motor drive assembly for transmitting driving force from said binder to said pump when both said binder drive assembly and said motor drive assembly are operating.

16. An apparatus as set forth in claim 11 comprising first heating means disposed within said first roller for maintaining the temperature of said first roller at a first predetermined temperature above ambient temperature, second heating means disposed within said second roller for maintaining the temperature of said second roller at a second predetermined temperature less than said first predetermined temperature, and glue heater means in communication with said glue reservoir for heating the body of glue and for maintaining the body of glue in a liquid melted state.

17. An apparatus as set forth in claim 16 wherein:

said first roller has a cylindrical inner surface defining an axially extending central passage in said first roller, said first heating means comprising a cartridge heater supported adjacent to said first roller and having a heat radiating portion extending axially into said central passage in said first roller, said first roller being rotatable around said heat radiating portion of said cartridge heater; and a heat transfer sleeve disposed in said passage intermediate said heat radiating portion of said cartridge heater and said first roller, said heat transfer sleeve having a cylindrical outer surface spaced radially inward from said cylindrical inner surface of said first roller.

* * * * *